United States Patent [19]

Gugel

[11] Patent Number: 4,541,745

[45] Date of Patent: Sep. 17, 1985

[54] PRINT HEAD CONSTRUCTION

[75] Inventor: Bernd Gugel, Ulm-Einsingen, Fed. Rep. of Germany

[73] Assignee: Mannesmann AG, Duesseldorf, Fed. Rep. of Germany

[21] Appl. No.: 553,827

[22] Filed: Nov. 21, 1983

[30] Foreign Application Priority Data

Nov. 22, 1982 [DE] Fed. Rep. of Germany ..... 3243475

[51] Int. Cl.[4] ..... B41J 3/12

[52] U.S. Cl. ..... 400/124; 101/93.05

[58] Field of Search ..... 400/124; 101/93.05, 101/93.04; 335/278, 281

[56] References Cited

U.S. PATENT DOCUMENTS

| | | | |
|---|---|---|---|
| 4,049,107 | 9/1977 | Murat | 400/124 |
| 4,230,412 | 10/1980 | Hebert | 101/93.05 X |
| 4,279,518 | 7/1981 | Blomquist et al. | 400/124 |

*Primary Examiner*—Paul T. Sewell

*Attorney, Agent, or Firm*—Ralf H. Siegemund

[57] ABSTRACT

The coil carrier for a print head is constructed from nested sheet metal bodies with upwardly bent legs, being aligned in pairs and held together by a common sleeve having an end face which has a singular relationship to a common end face of all the arms. The several armatures pivot on edges of respective one of the legs of each pair and are held by retraction springs against the common end face.

5 Claims, 4 Drawing Figures

PRINT HEAD CONSTRUCTION

BACKGROUND OF THE INVENTION

The present invention relates to a print head for matrix printers using wires or needles as styli, the styli being electromagnetically actuated and, more particularly, the present invention relates to a construction for such a head which includes a carrier for the several coils as well as for a corresponding plurality of magnetic yokes and armatures, the armatures having pivot arm function and abut the rear end of the needles or wires; the front end of these styli impact upon a record medium such as paper or the like upon respective energization and/or deenergization of the electromagnetic coils.

Print heads of the type to which the invention pertains reciprocate usually in front of a parallely arranged platen and the record medium is interposed between the platen and the print head. Continuous or step-wise advance of the record medium in conjunction with the operation of the print head produce alpha-numerical characters. The overall operation has as one of its parameters the reciprocating speed of the head; another parameter is the frequency of operation of the individual styli. These parameters are, of course, decisive of the overall print speed but also for the precision and accuracy of printing the appearance of the sign and, finally, on the life of the head.

Print heads are known in a variety of constructions characterised by various degrees of complexities which reflect on one hand in numerous tolerances which occasionally may occur cumulatively resulting in overall inaccuracies of the manufacturing and these inaccuracies are, for example, reflected in positional errors for the styli, the armatures and other movable parts. Therefore, the known print heads operate comparatively inaccurately and wear rather rapidly so that their life is quite limited.

DESCRIPTION OF THE INVENTION

It is an object of the present invention to provide a new and improved print head for matrix printers of the needle or wire stylus type which is constructed to permit extreme accurate manufacture without accumulation of tolerances to thereby avoid or at least eliminate or ameliorate problems concerned with and related to the movement of the styli and of the life of the head as a whole.

In accordance with the preferred embodiment of the present invention, it is suggested to provide a coil carrier by means of two, basically trough-shaped nested bodies made of thin material and each carrying bent-up legs whereby the two bodies are interconnected such that the legs are respectively aligned in pairs and constitute two yokes, one of them receiving a coil which will operate an armature on the front end of the respective leg of the pair. Both bodies, of course, are made ofo magnetizable material.

The construction in accordance with the principles of the invention offers the advantage that the abutment surfaces for controlling positions of the armature in critical points can be made uniformly and very accurately. This means that, as a matter of principle, the object is incumbered by only a single value of tolerance which is the same for all yokes and for all electromagnetic systems that include these yokes. Therefore the tolerance is not effective in between them. This tolerance is based upon the position of a common surface against which all the armatures abut; that particular surface has a singular spatial relationship to the front faces of all the yokes which end in a common and, most importantly, commonly established plane. Therefore the tolerance to be considered is the tolerance in the spatial relationship between the common abutment surface for all of the armatures on one hand and the commonly established front end face for all of the yokes on the other hand. One of the most important problems which troubled constructions in the past, namely tolerance deviations as between the several magnetic yokes and, thus, between the several magnetic actuating circuits of the several styli, does not appear any longer. These tolerances as they existed in the past were instrumental in producing deviations in the motion characteristics of the individual styli and in cases had to be compensated separately and individually. No such step is necessary any longer.

Another advantage of the present invention is to be seen in that the inventive coil carrier, after its manufacture, is completely free from internal stress, for example, after removal from a clamping mechanism in which the carrier was placed, for example, for purposes of establishing the common front plane of all of the magnetic yokes. Should the body have any residual internal stresses, they will have shown their effect beforehand, and the common cutting for establishing the common front face plane for the yokes indeed eliminates this kind of local deviation.

The principle underlying the design and construction of the inventive coil carrier is applicable to different types of arrangements, particularly as far as individual print needles and styli are concerned. In the case of a matrix head which moves across the platen, it is of advantage to retain the basically known annular configuration, and in this case, the body is of a star-shaped arrangement. The two bodies of which the coil carrier is made are interconnected in a concentric relationship. Alternatively, each of these bodies may be of a longitudinal trough-shaped configuration with U-shaped cross-sectional profile and again, they are combined in a nested configuration.

In each of these cases, the two bodies of which the coil carrier is constructed may be interconnected and secured to each other in a variety of manners such as riveting, soldering, welding, or by means of a metallic adhesive, or alternatively they may be bolted or screwed to each other. For purposes of combining and joining the two bodies it must be made sure that they are assembled in a fixed and predeterminable relationship. In the case of an annular configuration it is of advantage to provide each of these bodies with a sintering board and they are concentrically positioned as far as the legs are concerned by aligning the two bores axially and clamping the otherwise inteconnecting these two bodies through insertion of a centering sleeve. The centering sleeve may have an axial front end provided with a recess in which is inserted a wearproof and/or resilient disk defining the abutment surface for all of the armature. This particular disk has a supplemental effect, namely it dampens the impact of a needle or stylus as it is being retracted from the recording medium. Thus, the particular insert is constructed to attenuate as much as possible the vibration that may occur as the armature impacts upon it. Consequently, any armature pivotting and any needle retraction is stopped very quickly, which in turn is highly instrumental in obtaining a high print speed because the needle or stylus is very early ready for another operating cycle.

Concerning the above identified tolerance relationships it is pointed out that the common tolerance for all of the needles and circuits is established by making sure that the front ends of all the legs are made to lie in a common plane without any tolerances as far as deviation from the plane is concerned while on the other hand there is a definite relationship of that plane to the abutment surface of the damping element inserted in the mounting sleeve as stated. This means that, as far as the needle positioning accuracy is concerned, there is a single, i.e. common tolerance present in the system which is the tolerance of the accuracy of the common plane on one hand and of the abutment surface for the armatures on the other hand. That tolerance is not effective in between the individual armatures, styli, etc.

The sleeve and the bodies establishing the coil carrier may in addition be aligned through a matching system of grooves and ridges which not only faciliates angular alignment to obtain radial alignment of the arms or legs but also aids in establishing concentricity which in turn is instrumental in establishing a uniform spacing between aligned legs.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 3:
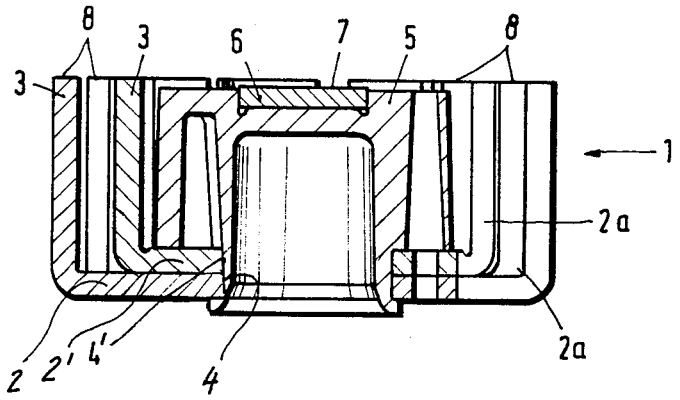
FIG. 3 illustrates a section view through the coil carrier itself, the carrier being included in the assembly shown in FIG. 1.
Figure 4:
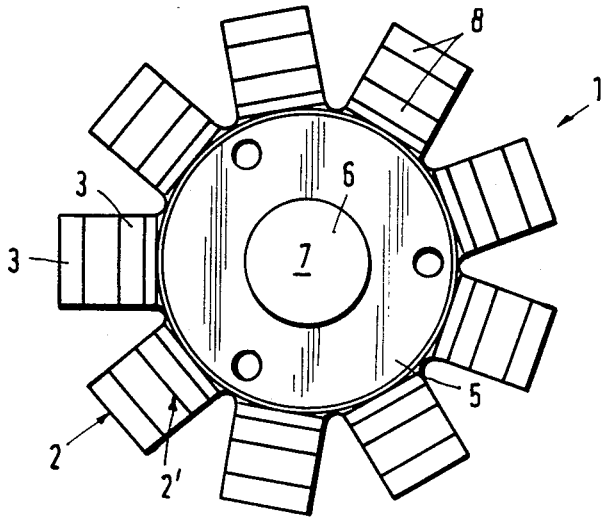
FIG. 4 is an elevational view of the coil carrier shown in FIG. 3.

Proceeding now to the detailed description of the drawing, reference is made first to the coil carrier shown in greater detail in FIGS. 3 and 4 and identified here and elsewhere by reference numeral 1. This coil carrier constitutes a modular unit. The unit is comprised of two basic elements, 2 and 2', respectively, each being made originally from flat, punched metal sheets or plates. These two bodies are provided in that fashion with radially extending legs 3 and the legs have been bent, basically by 90° to establish yokes. Actually, the legs 3 of element or body 2 establish the core for the respective electromagnetic actuator.

The two elements 2 and 2' when assembled establish a trough 2*a*. The two elements 2 and 2' are particularly assembled in a nested configuration so that respective two yoke arms appear in a radially aligned position with a gap in between. Moreover, the two elements or 2 and 2' are respectively provided with the central bores 4 and 4', respectively, which are axially aligned in this assembled position. Finally, the two bodies 2 and 2' are secured to each other by means of a central sleeve 5.

In the case of round print heads, the base body is, in fact, annularly star-shaped as illustrated in FIGS. 3 and 4. Alternatively, a basically rectangular trough can be provided in which case the two bodies are of an overall U-shaped, longitudinally extending profile. The basic bodies may in any event be riveted together or welded, soldered or bonded together by means of a metallic adhesive.

The particular body and carrier construction illustrated in FIG. 3 and here particularly the center sleeve 5 is provided with a recess in which an abutment disk 6 made of resilient and/or wearproof material is arranged having particularly an abutment surface 7. This surface 7 is slightly recessed axially with respect to a common plane 8 in which all of the yoke legs 3 end.

Figure 1:
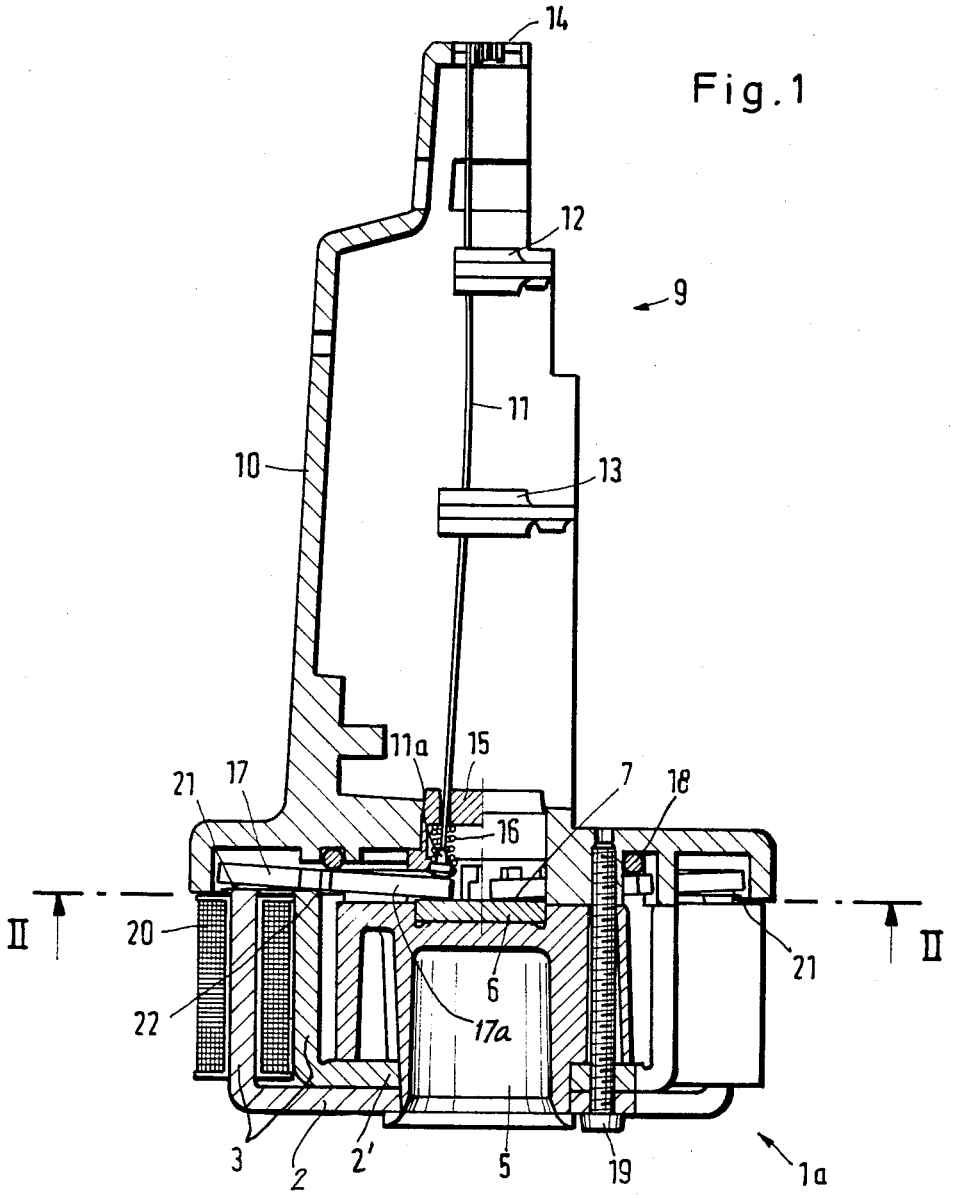
FIG. 1 is an axial cross-sectional view through a print head constructed in accordance with the preferred embodiment of the present invention for practising the best mode thereof.
Figure 2:
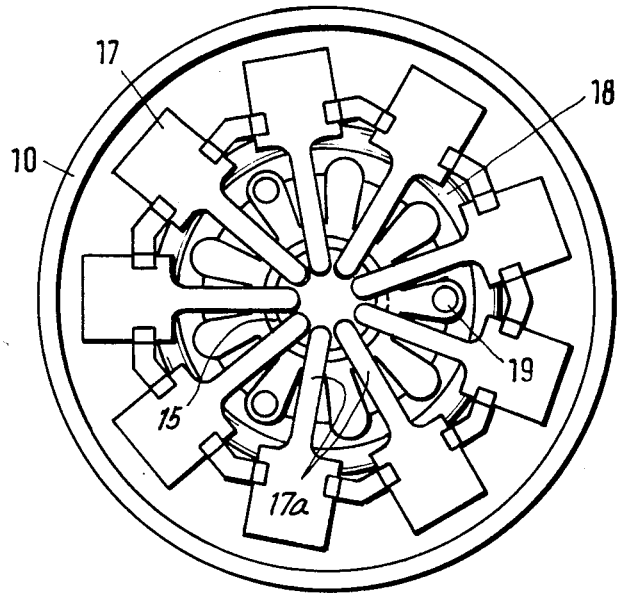
FIG. 2 is a section view taken in the plane II—II as indicated in FIG. 1, the head being shown with the electromagnetic coil subassembly being removed.

The coil carrier as shown in FIGS. 3 and 4 is inserted in and part of a print head shown in FIGS. 1 and 2. This print head can be deemed to be comprised of a coil carrying module or group 1*a* and a needle guide module 9. This needle or stylus guide module 9 includes a casing 10 and the front end 10*a* of this case is provided with a mouthpiece 14 for holding and supporting the front end of the needles or styli 11; only one of these needles, wires or styli is shown in FIG. 1.

The styli 11 are in addition passed through bearing elements 12 and 13 for establishing a very accurately definable displacement path and well-defined positions for each portion of such a wire or stylus in any of the different displacement positions. The portion of each stylus more to the rear is passed through a multiple guide sleeve 15, and the respective styli traverse this sleeve and end in a head portion 11*a* against which bears a retraction or operating spring 16. The respective other end of this compression spring bears against the sleeve 15. Generally speaking, the spring 16 has the tendency to retract the needle 11, particularly with respect to the mouthpiece 14. The spring, moreover, urges the head 11*a* against an armature 17.

There are, of course, as many armatures as there are styli and each armature 17 is pivotable about a pivot axis defined by the inner edge of a leg 3 of body 2' whereby, in fact, the compression spring 16, through the head 11*a*, urges the arm 17*a* of armature 17 into abutment with the surface 7 of the abutment element 6 in the coil carrying assembly 1*a*. It can thus be seen that the starting position of all of the needles 11 are defined on one hand by the accuracy of the thickness of all of the armatures 17 and by the accuracy of the plane 7 of the abutment piece 6. That plane bears a fixed relationship to the plane defined by the front ends of all of the yokes which is premanufactured as part of the coil carrying assembly. The mutual relationship of these parts is established by the abutment plane in the front end of the sleeve 5 and of the housing or casing 10 as it supports the various bearings for the print needles.

It can readily be seen that reproducible relationships are established by means of this assembly, and the overall system will return to an operating state defined by these positions even after several assemblies and disassemblies have taken place. The screws 19 establish the connection between the coil carrying assembly 1*a* and the styli guide module 9. The armature stroke is limited for higher frequencies under utilization of the bearing 18. Moreover, the assembly and positionable relationship described thus far establishes a very accurate and uniform working air gap 21 between each of the yokes 3 and coils 20 on one hand and the pivotable armatures 17 on the other hand. Uniformity of the working air gap throughout the system is, of course, highly instrumental in attaining favorable magnetic flux conditions and predictable stray flux conditions.

As far as the armatures 17 are concerned, it is, of course, essential that the respective fulcrum 22 of each of them is precisely defined. The precision here is the result of precision in the manufacture of the coil carrier 1 in conjunction with the accuracy of establishing the plane 7, which in turn bears definite relationship to the abutment surface 7 of disk 6. The individual yokes 3, of course, define individually reference surfaces for the respective armature but a cutting operation establishing a common plane for all of these front phases 8 is instrumental in obtaining uniformity in the mechanical situation that establishes the positional accuracy ultimately of the rear end of each of the print needles. It should be emphasized that a common cutting operation involving all of the yokes 3 for establishing this common reference plane 7 is an immediate consequence of the construction and structure of the carrier 1. Only through this approach is it possible to establish in effect a tolerance of zero as between the individual yoke front faces 8 with respect to each other.

The invention is not limited to the embodiments described above, but all changes and modifications thereof, not constituting departures from the spirit and scope of the invention are intended to be included.

I claim:

1. In a print head of the needle or wire stylus variety having a plurality of electromagnetically actuated print needles, wires or styli, the combination comprising a coil carrier constructed from two separate, nesting, relatively thin walled carrier elements, each having a base and upwardly extending legs which are respectively radially aligned whereby respective two aligned legs pertain to different carrier elements for establishing a yoke and a core for a particular coil, the two elements being secured to each other; and a plurality of pivotable armatures respectively associated with styli and with pairs of aligned legs whereby one leg of each pair respectively serves as fulcrum for the respective armature.

2. Coil carrier as in claim 1 wherein each of the nested elements are made of sheet metal, the respective legs being bent up.

3. Coil carrier as in claim 1 wherein each of these elements is provided with a central opening, there being a centering sleeve inserted in said opening.

4. Coil carrier as in claim 3 wherein said sleeve has an end with a recess, there being an abutment disk inserted in said recess made of elastic and wearproof material, said armatures normally engaging said abutment surface being oriented at right angles to a common direction of propulsion of said styli.

5. Coil carrier as in claim 4 wherein said legs each have a front end, all of said front ends being situated in a common and commonly established plane having a particular spatial relationship to said abutment surface.

* * * * *